US006032294A

United States Patent [19]

Dean

[11] Patent Number: 6,032,294

[45] Date of Patent: Mar. 7, 2000

[54] FASTENER FOR MATING PAIRS OF CLOTHING ITEMS

[76] Inventor: Galilea V. Dean, 1520 Larkhaven Dr., Chula Vista, Calif. 91911

[21] Appl. No.: 09/268,323

[22] Filed: Mar. 16, 1999

[51] Int. Cl.[7] ..... A41B 11/00

[52] U.S. Cl. ..... 2/239

[58] Field of Search ..... 2/239; 24/662

[56] References Cited

U.S. PATENT DOCUMENTS

| | | | |
|---|---|---|---|
| D. 327,149 | 6/1992 | Harper, IV . | |
| D. 363,579 | 10/1995 | Scaglione et al. . | |
| 2,663,877 | 12/1953 | Bohman . | |
| 3,688,348 | 9/1972 | Klotz et al. | 24/16 |
| 3,699,617 | 10/1972 | Hofmeister . | |
| 4,165,555 | 8/1979 | Boxer et al. | 24/204 |
| 5,038,413 | 8/1991 | Ursino . | |
| 5,321,855 | 6/1994 | Ciuffo . | |
| 5,357,660 | 10/1994 | Smith . | |
| 5,490,309 | 2/1996 | Velasquez et al. . | |
| 5,579,541 | 12/1996 | Christy et al. . | |
| 5,699,557 | 12/1997 | Johnson | 2/239 |
| 5,708,984 | 1/1998 | Shofner | 2/239 |
| 5,740,558 | 4/1998 | Messman . | |
| 5,918,318 | 7/1999 | Jones | 2/239 |

FOREIGN PATENT DOCUMENTS

| | | |
|---|---|---|
| 2 680 083 | 2/1993 | France . |
| WO 91/04684 | 4/1991 | WIPO . |

*Primary Examiner*—Diana Oleksa
*Assistant Examiner*—Kate Moran
*Attorney, Agent, or Firm*—Richard C. Litman

[57] ABSTRACT

A sock pair or glove pair is disclosed having a first and a second sock or glove and at least one snap fastener. Each snap fastener has a male part, a female part, and two securing parts. At least one snap fastener is a retaining snap fastener. Each sock or glove has a U-shaped fabric tab folded over the upper or wrist edge of the sock or glove. The tab is retained on the sock or the glove by the male or the female part and one of the securing parts of the retaining snap fastener. The retaining snap fastener is located at a fastener distance from the upper or wrist edge of the sock or glove. The fastener distance is at least the fastener width and may be up to 2.5 times the fastener width. At least one of the tabs has an indicia indicating the source of the sock or glove. The inner and outer distal edges of each tab preferably conform to the shape of the snap fastener holding the tab on. The glove or sock pair is comfortable, durable, and particularly suited for inexpensive mass production by machine. The pair can be easily mated when desired for laundering or storage.

14 Claims, 4 Drawing Sheets

FASTENER FOR MATING PAIRS OF CLOTHING ITEMS

BACKGROUND OF THE INVENTION

1. Field of the Invention

The present invention relates to fasteners for items of clothing.

2. Description of the Related Art

Keeping pairs of clothing items together is well known to be a difficult task. Socks and gloves easily become separated, either when stored in a drawer or when laundered. Particularly in households with children, an enormous amount of time can be wasted searching for the mate to a sock or a mitten. If the mate is not found, the other member of the pair generally must be discarded.

Matching pairs of socks is more difficult if a large number of socks are being washed, as may be the case in a hospital, nursing home, or large household. Matching pairs can be especially difficult if various pairs of socks are being laundered which are similar in appearance but do not match. Socks come in a variety of colors and fabrics, many of which can be difficult to distinguish under ordinary lighting conditions. Different sizes of socks can also be hard to sort out, such as when men's and women's socks of the same color and brand are laundered together.

Numerous methods have been invented for mating socks. Most: available methods involve a detachable sock mating device. This approach requires that a number of the devices be stored ready for use whenever the socks are removed. Since socks may be removed nearly anywhere, this often involves storing a supply of devices in several locations. Care must also be taken when the socks are put on that the device is returned to its proper place. Unfortunately, socks may also be put on nearly anywhere, and there is a tendency to simply toss the device aside. This leads to problems in finding the device later.

Some sock mating devices can be used with only certain types of socks. For example, some sock mating devices require different sizes for socks which are unusually small or thin, such as children's socks. Others have trouble with very large or thick socks. This increases the difficulty of maintaining a supply of the devices ready for use.

Detachable sock mating devices have other disadvantages. Many devices are bulky and decrease the number of socks which can be stored in a given space. This is especially critical where space is at a premium, such as in a medical facility. Some devices interfere with proper laundering of the sock. Some sock mating devices involve repeatedly stretching or piercing the sock material. This damages the sock and reduces its useful life.

It is known to attach sock mating devices to individual socks. However, many such devices are expensive to attach and add significantly to the cost of the sock. The stretchy knitted material of a typical sock can be difficult to handle. Many sock mating devices also have a tendency to tear the sock material, reducing the sock's life. Many sock mating devices are labor-intensive to attach and unsuited for mass production by machine. For example, many sock mating devices are stitched in place, a labor-intensive process.

U.S. Pat. No. 2,663,877 to Bohman discloses a means for keeping socks together during laundering having a fabric strip tab doubled over the top of the sock. A snap fastener is secured against the outer portion of the tab near the top of the sock. The tab is stitched in position. The top of the tab may extend beyond the sock, forming a small passageway through which a D-shaped metal or plastic loop may be inserted.

U.S. Pat. No. 5,038,413 to Ursino discloses a fastening device for securing a pair of socks together. The fastening device may include a snap, button-hole, velcro-type, or hook and eye type fastener. The fastening device is permanently attached to each sock. The device may have a reinforcement band attached to the upper end of the leg portion of the sock with a snap fastener. The snap fastener may have a decorative cover attached.

U.S. Pat. No. 3,699,617 to Hofmeister discloses a connecting device for detachably joining socks. The device has two identical connecting members of flexible plastic. Each member is permanently attached to one of the socks. Each connecting member has a front and a rear section connected by a hinge means. The member is folded at the hinge over the top of the sock. The member fastens in place on the sock with a pair of locking studs and flanges. Decorative insignia may be attached to the connecting members. A pair of integral, complementary plugs on each connecting member snap fit to join the socks together for laundering.

U.S. Pat. No. 5,321,855 to Ciuffo discloses a permanently attached hook and loop fastening system for pairing socks, hosiery and gloves.

U.S. Pat. No. 5,579,541 to Christy et al. discloses a sock tab attached to each of a pair of socks and extending above the upper edge. Each tab includes a patch of hook and pile fastener for attaching a pair of socks together. Each tab may also include a trade mark or other decorative indicia.

U.S. Pat. No. 5,740,558 to Messman discloses a device for attaching flexible articles together consisting of a flexible strip sewn to the edge of the article. The end of the flexible strip may include a snap fastener. The flexible strip may be of reinforcement tape, and is attached to the sock by stitching.

None of the above inventions and patents, taken either singly or in combination, is seen to describe the instant invention as claimed.

SUMMARY OF THE INVENTION

The present invention is a sock pair or a glove pair. The sock or glove pair includes a first and a second sock or glove, and at least one snap fastener. Each snap fastener has a male part, a female part, and two securing parts. At least one snap fastener is a retaining snap fastener. Each sock or glove has a U-shaped fabric tab folded over the upper or wrist edge of the sock or glove. The tab is retained on the sock or the glove by the male or female part and one of the securing parts of the retaining snap fastener. Each snap fastener is located at a fastener distance from the upper or wrist edge of the sock or glove. The fastener distance is at least the fastener width and may be up to 2.5 times the fastener width. At least one of the tabs has an indicia indicating the source of the sock or glove. The inner and outer distal edges of each tab preferably conform to the shape of the snap fastener holding the tab on. The arrangement of the tab and snap fastener is comfortable, durable, and particularly suited for inexpensive mass production by machine. The sock or glove pair can be easily mated when desired for laundering or storage.

Accordingly, it is a principal object of the invention to provide a sock or glove pair having two socks or gloves, at least one snap fastener retaining a pair of U-shaped tabs, and at least one indicia indicating the source of the sock or glove.

It is another object of the invention to provide a sock or glove pair having a snap/tab fastener which is comfortable to wear and is durable, without any tendency to tear the material of the sock or glove.

Another object of the invention is to provide space on the sock or glove for display of indicia indicating the source of the item, without interfering with the wearer's comfort.

It is a further object of the invention to provide a sock or glove pair which allows for easy mating of the pair when desired for washing or storage, without requiring attachment of a separate device.

Still another object of the invention is to provide a sock or glove pair having a snap/tab fastener which is suitable for inexpensive mass production by machine.

It is an object of the invention to provide improved elements and arrangements thereof in an apparatus for the purposes described which is dependable and fully effective in accomplishing its intended purposes. Thus a sock or glove pair solving the aforementioned problems is desired.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
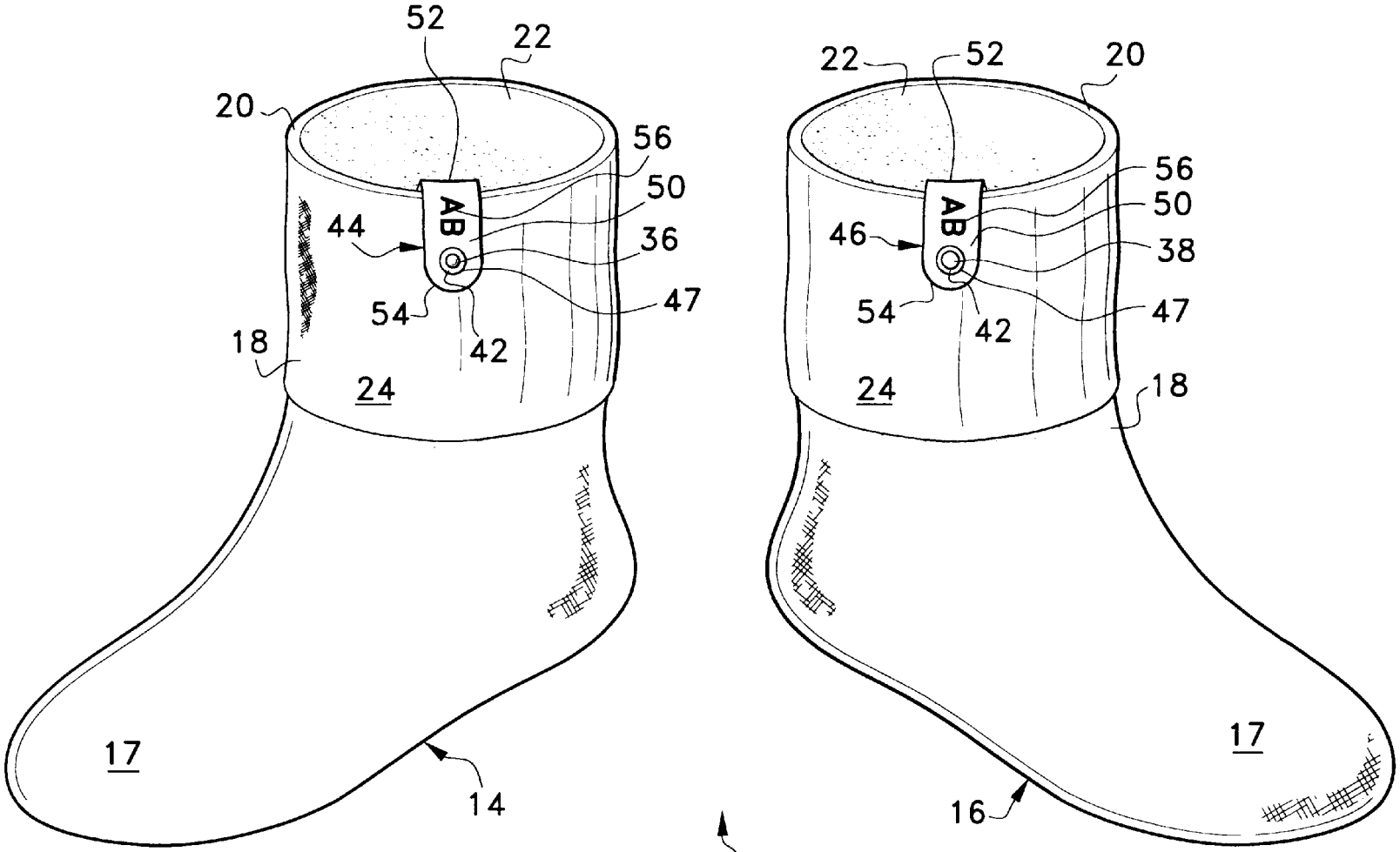
FIG. 1 is a perspective view of a sock pair according to the present invention.

The present invention is a sock pair 10 or a glove pair 12. Each sock pair 10 includes a first and a second sock 14 and 16, as shown in FIG. 1. The sock material is a knit with at least some stretch. The sock may be an adult sock, a child's sock, a baby bootie, or any similar foot covering of stretchable material. Each sock 14 or 16 has a foot portion 17, a leg portion 18, and an upper edge 20. Each sock 14 and 16 has an inner surface 22 and an outer surface 24. The leg portion 18 of each sock has a longitudinal axis extending from the upper edge 20 toward the foot portion 17. The top of the sock may be folded over in bobby sock style, as in FIG. 1. In this case the upper edge of the sock is a fold line.

Each glove pair 12 has a first and a second glove 26 and 28. See FIG. 6. The glove material is a knit with at least some stretch. Note that the term "glove" refers to any hand covering of stretchable material, and may include mittens, fingerless gloves, etc. Leather gloves are not part of the invention. Each glove has a hand portion 30, a wrist edge 32, an inner surface 22, and an outer surface 24. The hand portion 30 has a longitudinal axis extending from the wrist edge 32 towards the tips of the fingers 34.

Each sock pair 10 and glove pair 12 has at least one snap fastener. The snap fastener is light enough in weight so that there is no tendency for the upper edge of a sock to be dragged down. Light weight is less important for gloves, but still a factor in the wearer's comfort. The preferred snap fastener material is plastic, which is light in weight and inexpensive. For heavy socks, nickel or other metal snap fasteners may be necessary to prevent separation during laundering.

At least one snap fastener is a retaining snap fastener 42 for retaining the tab on the sock or glove. Each snap fastener has a male part 36, a female part 38, and two securing parts 40A and 40B. See FIGS. 2 and 3. Each snap fastener also has a fastener width. The fastener width varies according to the weight of the socks to be joined. For typical socks, a fastener width of 1.1 centimeters or 7/16 inches is suitable.

The male part 36 of each snap fastener has a central projection 41. The female part 38 has a central aperture 43. The male part 36 and the female part 38 are adapted to removably attach to each other, with the projection snap fitting into the aperture.

Each securing part 40 attaches to one of the male or female parts 36 and 38. Typically, each securing part 40 has a set of prongs 45 which extend through the material of the tab and the sock or glove. The prongs 45 deform to fixedly attach the securing part 40 to the rim 39 of the corresponding male or female part 36 or 38.

The rear face of each securing part, opposite the prongs, is adjacent to the wearer's skin when the sock or glove is worn. It is therefore important that the rear face be smooth and comfortable. The rear face is preferably as low-profile as possible and has no decoration. Ideally the securing part is a simple flattened ring with attached prongs.

Each sock pair 10 and glove pair 12 includes a first and a second tab 44 and 46. Each tab 44 or 46 is composed of a fabric strip. The fabric is a soft, flexible woven fabric that has little or no stretch, so that it can support the underlying knit materiaL. If the fabric of the tab is too stiff, the edges will be uncomfortable against the wearer's skin. Suitable fabrics include acetate, cotton, nylon, polyester, and blends. Preferably the fabric is lightweight, porous, and wrinkle-resistant. Cotton or a cotton blend is preferred, as the most comfortable. The weight of the fabric is dependent on the size and weight of the snap fastener. For typical socks and gloves a cotton blend of the weight typically used in T-shirts is suitable.

Each tab 44 or 46 is U-shaped and has an inner end 48 and an outer end 50. For a sock pair, each tab is preferably located on the leg portion toward the outside of the leg or the ankle, as shown in FIG. 1. This provides a more conspicuous location for the indicia, and also prevents the male and female parts of the snap fastener from rubbing together while walking. For a glove pair, each tab is preferably located toward the back of the hand, for similar reasons.

Figure 2:
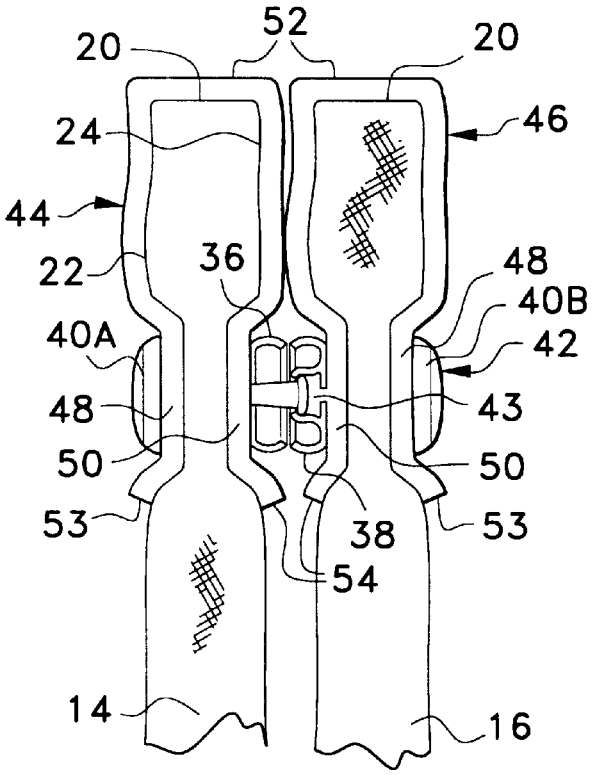
FIG. 2 is a detail, side, cross-sectional view of a retaining snap fastener and a tab.
Figure 3:
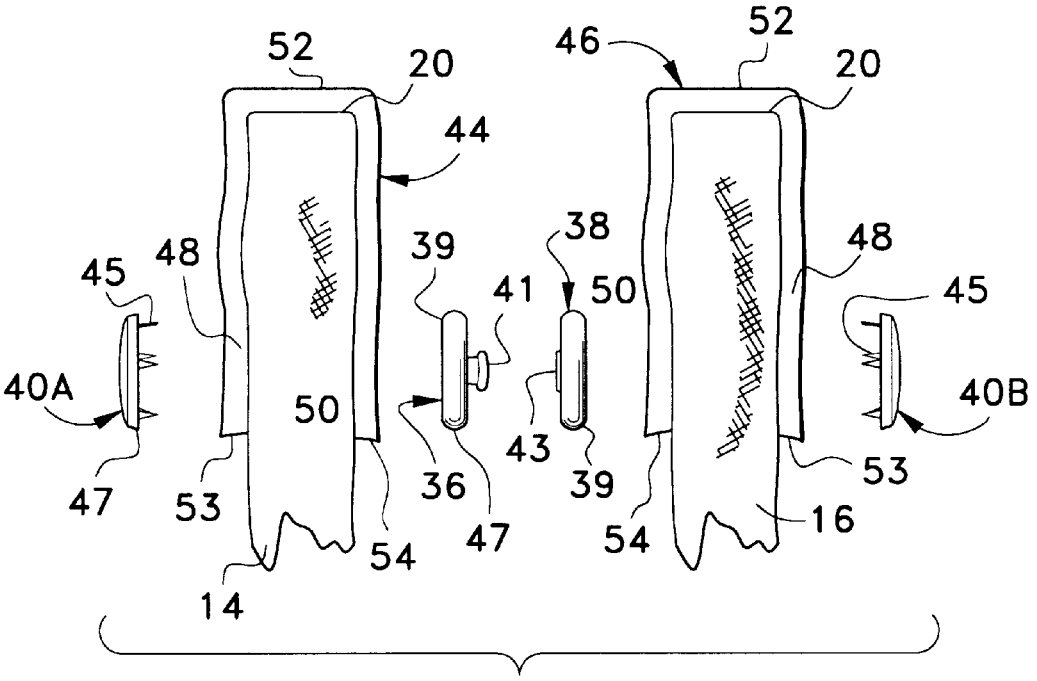
FIG. 3 is an exploded, side, cross-sectional, detail view of the retaining snap fastener and tab of FIG. 2.

Each tab 44 and 46 has a folded edge 52. The folded edge 52 of each tab is located proximate to the upper edge 20 or the wrist edge 32 of the sock or glove to which the tab is attached. The folded edge may conform to the upper or wrist edge, as shown in FIGS. 2 and 3.

Preferably the folded edge 52 has a single fold line, as shown in FIGS. 1 and 4–6. A single fold line reduces the manufacturing expenses for the tab, and simplifies automated attachment of the tab to the sock or glove. Attaching a folded tab simplifies manufacture. In contrast, using a single unfolded piece of fabric for reinforcement is insufficient, since the opposite surface of the sock or glove is not protected against tearing. Using two separate pieces of fabric for reinforcement makes attachment complex. Centering the snap fastener in the appropriate location is considerably simpler with a folded tab.

The size of the tab is determined by the size of the snap, which is in turn determined by the weight of the sock. Preferably the tab is no wider than twice the fastener width, and no longer than three times the fastener width from the folded edge to the distal edge. Minimizing the size of the tab helps to maintain a neat appearance.

Several different tab shapes are suitable for the invention. Each tab may be rectangular or generally rectangular and oblong, as in FIGS. 4 and 5. Each distal edge may be angular, as shown in FIG. 6. For tabs with rectangular or angular ends, the corners may be rounded to avoid discomfort. In a preferred embodiment, each distal edge is semicircular. See FIG. 1.

The inner and outer ends 48 and 50 of each tab 44 and 46 have an inner and an outer distal edge 53 and 54 respectively. The longitudinal axis of each tab is parallel or generally parallel to the longitudinal axis of the leg portion 18 or the hand portion 30 of the sock or glove to which the tab is attached.

The inner end 48 of each tab 44 or 46 is located between one of the securing parts 40 of the retaining snap fastener 42 and the sock or glove to which it is attached. See FIGS. 2 and 3. The outer end 50 of each tab is located between the male or female part 36 or 38 of the retaining snap fastener 42 and the sock or glove. The inner and outer ends 48 and 50 are therefore adjacent to the inner and outer surfaces 22 and 24 respectively.

The male part 36 and the securing part 40A of the retaining snap fastener 42 are fixedly attached to each other and retain the first tab 44 on the first sock 14 or first glove 26. The female part 38 and the securing part 40B are fixedly attached to each other and retain the second tab 46 on the second sock 16 or second glove 28.

Many prior art sock attachment devices are permanently attached to the sock by sewing or a heat-sensitive adhesive, either alone or as a supplement to a snap fastener. Either stitching or an adhesive considerably complicates the manufacturing process and adds expense to the sock.

Sewing, in particular, requires handling of each sock individually, and the resulting threads must be trimmed. Sewing is a labor-intensive process; sewing a highly elastic material is difficult in itself. The resulting stitching often lacks durability when exposed to repeated stretching of the underlying knit. Sewing may also break some of the elastic fibers in the sock material and predispose the sock to tearing. For these reasons, attaching the tab by stitching in addition to the snap fastener is unsuitable for the present invention.

Attachment with heat-sensitive adhesive is easier to automate, but the adhesive has difficulty in stretching with the sock or glove as the wearer moves. This leads to rapid deterioration of the adhesive and discomfort for the wearer. Therefore, while the tab may be attached by a heat-sensitive adhesive, the retaining snap fastener is optimally the sole fastener attaching each tab to each sock or glove.

Figure 4:
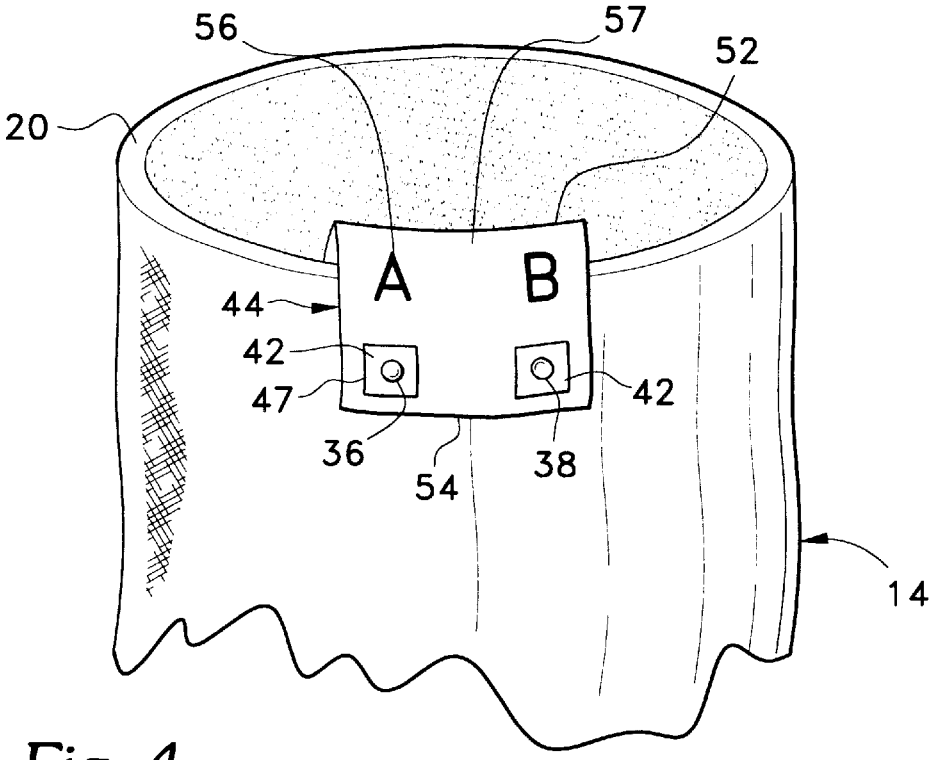
FIG. 4 is a detail view of a rectangular tab with two square retaining snap fasteners.

Each of the male, female, and securing parts of the retaining snap fastener 42 has an outer edge 47 proximate to the distal edge 53 or 54 of the corresponding end 48 or 50 of each tab. Each outer edge 47 has a shape. Preferably each distal edge 53 or 54 conforms to the shape of the corresponding outer edge 47. See FIGS. 1, 4, and 6. Preferably the distal edge 53 or 54 extends no further than the fastener width from the corresponding outer edge 47, as shown in FIGS. 1, 4, and 6. Preferably the distal edges extend no less than one-third the fastener width from the outer edge.

Several different corresponding shapes are possible for the tab and the snap fastener. For example, the semicircular shape of the distal edges of the tabs of FIG. 1 conforms to the round outer edge of the retaining snap fastener. If the retaining snap fastener is square or generally square, each tab is preferably generally rectangular and oblong, as in FIG. 4. If the retaining snap fastener is triangular or generally triangular, the distal edges ideally are angular, as shown in FIG. 6.

Conforming the distal edges of the tab to the shape of the retaining snap fastener has several advantages. Nonconforming distal edges tend to fold unevenly during washing or wearing. This can be uncomfortable and unsightly. Conforming distal edges, on the other hand, do not bunch up or fold over on themselves. This is comfortable for the wearer and gives the sock or glove a neat appearance, even after many washings. The upper portion of the tab, between the folded edge and the retaining snap fastener, does not need to conform to the shape of the fastener since the sock or glove holds it stretched out.

The retaining snap fastener 42 is located at a fastener distance from the upper or wrist edge 20 or 32 of each sock or glove. The fastener distance ranges from approximately the fastener width to approximately 2.5 times the fastener width. Preferably the fastener distance is between 1 and 2 times the fastener width, optimally 1.5 times or about 1.5 times the fastener width.

The tab provides support to the snap fastener and the sock or glove material. Since the material is a knit with some stretch, a snap fastener attached directly to the sock or glove would quickly tear out, and the material would unravel. The fabric tab allows for a secure attachment of the snap fastener with less tendency to tear the sock or glove. The area of the upper or wrist edge is the part of a sock or glove which typically has the most elastic content in the material. Since this area stretches a great deal, the support of the tab is particularly important.

Even with the tab's support, placement of the retaining snap fastener at the proper fastener distance is important to prevent tearing. If the snap fastener is too close to the upper or wrist edge, the snap fastener will tear through the edge. If the snap fastener is too far from the edge, the tab becomes unwieldy. The upper or wrist edge may fold over inside a long tab, or the tab may catch on objects. A tab with a snap fastener placed too far from the edge is likely to fold or twist, so that the sock or glove lacks a neat appearance. Optimal placement of the snap fastener is therefore important to the invention.

The sock or glove pair includes at least one indicia 56 indicating the source of the sock or glove. Preferably both tabs 44 and 46 have an indicia. The indicia may be a logo or the like. The indicia is preferably woven into the fabric of the tab to maximize flexibility and comfort. The indicia may be printed on the fabric of the tab, if desired. The indicia 56 is located between the folded edge 52 and the outer distal edge 53 of one or both of the tabs. Ideally the indicia is located between the retaining snap fastener 42 and the folded edge 52. This arrangement allows for visibility of the logo to purchasers and wearers of the sock or glove pair. For socks or gloves having special care requirements, such as high-tech hiking socks, suitable indicia may be included on the opposite side of the tab, adjacent to the wearer's skin.

The sock or glove pair of the present invention has several advantages over conventional methods of mating socks and other clothing items. The tab and snap are easy and inexpensive to attach by machine in the correct position. No supply of separate devices has to be maintained, and the device cannot be lost. The tabs and snaps add little or no bulk to a sock when laundering. Mating socks or gloves is very simple and easy; simply snap them together as they are removed. Children have no trouble snapping the fasteners together. Even geriatric patients and persons with arthritis find the attachment easy to make.

The snap fastener attachment is durable enough to keep a pair of socks together throughout laundering and drying. The material of the sock or glove is not compressed or bunched together when the pair is attached to each other water circulates freely during washing, and no extra time is needed for drying. The glove or sock pair remains mated and cannot be mixed up with other pairs. The pair is easily separated for wearing. The tab and snap are comfortable for the wearer and do not interfere with the normal function of the sock or glove. No time is wasted in searching for mating socks, gloves, and mittens.

For sock manufacturers, the space provided on the tab for source-indicating indicia is beneficial. Prior art knitted socks and gloves have generally not had space for indicia. Indicia printed on a sock tend to wear off easily, due to the stretching of the sock. Stitching or ironing on a label has generally not been practical, due to the expense involved and problems with durability and comfort. Socks which are similar in appearance often differ greatly in quality; consumers find it difficult to remember later what brand name a sock was purchased under when no label is attached. A label indicating the source allows consumers who are pleased with a particular sock to buy the same brand again. The dual function of the tab/snap fastener of the present invention in advertising and in mating the items makes attaching a label much more cost-effective. The sock or glove pair of the present invention is also comfortable to wear.

Preferably the sock or glove pair has a single snap fastener, as in FIGS. 1–3 and 6. This arrangement minimizes manufacturing expense. In an alternative embodiment of the invention, the sock or glove pair may include two retaining snap fasteners 42. See FIG. 4. The use of three or more snap fasteners is undesirable, due to the added expense and complexity of manufacture.

Preferably the fastener distance of each of the two retaining snap fasteners is approximately equal. Ideally each of the socks or gloves has one male part and one female part of the two snap fasteners, as shown in FIG. 4. This provides a more secure attachment that is less likely to separate during laundering.

The two retaining snap fasteners are separated from each other by a separation distance. The separation distance ranges from approximately the fastener width to approximately 2.5 times the fastener width. Preferably the separation distance is between 1 and 2 times the fastener width. If the separation distance is too small, fastening and unfastening the snap fasteners can be difficult. If the separation distance is too great, the amount of stretch in the sock or glove material between the snaps may lead to uneven stress and tearing.

The folded edge 52 of each tab 44 or 46 may extend upward beyond the upper or wrist edge 20 or 32 of each sock or glove by an extension distance. In these embodiments, each tab has an upper portion 57 which extends from the folded edge 52 of the tab to the upper or wrist edge 20 or 32 of the sock or glove. The extension distance is preferably less than 2.5 times the fastener width, to avoid the problems of folding and twisting associated with long tabs. Most preferably the extension distance is less than 0.5 times the fastener width, as in FIGS. 1 and 6. However, a longer extension distance may be used, as in FIG. 5.

If present, the upper portion 57 of the tab may have various uses. For example, the upper portion may be used for grasping the tab when separating the snap fasteners. This avoids wear and tear on the sock or glove material. For persons who have difficulty in grasping an ordinary sock or glove, the tab may be used in pulling the clothing item on and off. The tab may form a loop large enough for a finger to be hooked between the folded edge of the tab and the upper or wrist edge, as in FIG. 4. The upper portion also allows for additional space for the indicia. See FIG. 4.

Figure 5:
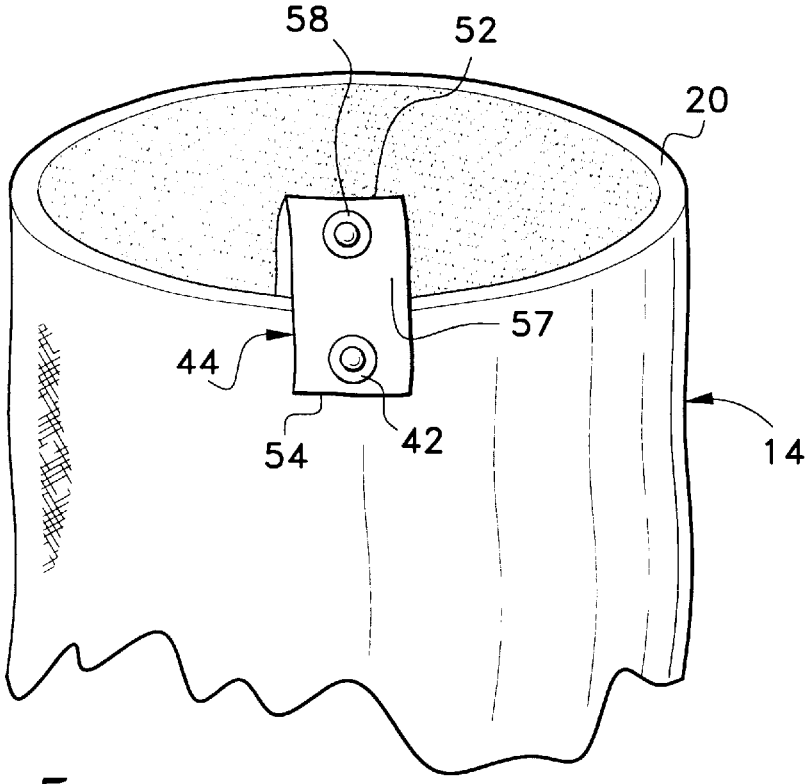
FIG. 5 is a detail view of a tab having a retaining snap fastener and a tab snap fastener.
Figure 6:
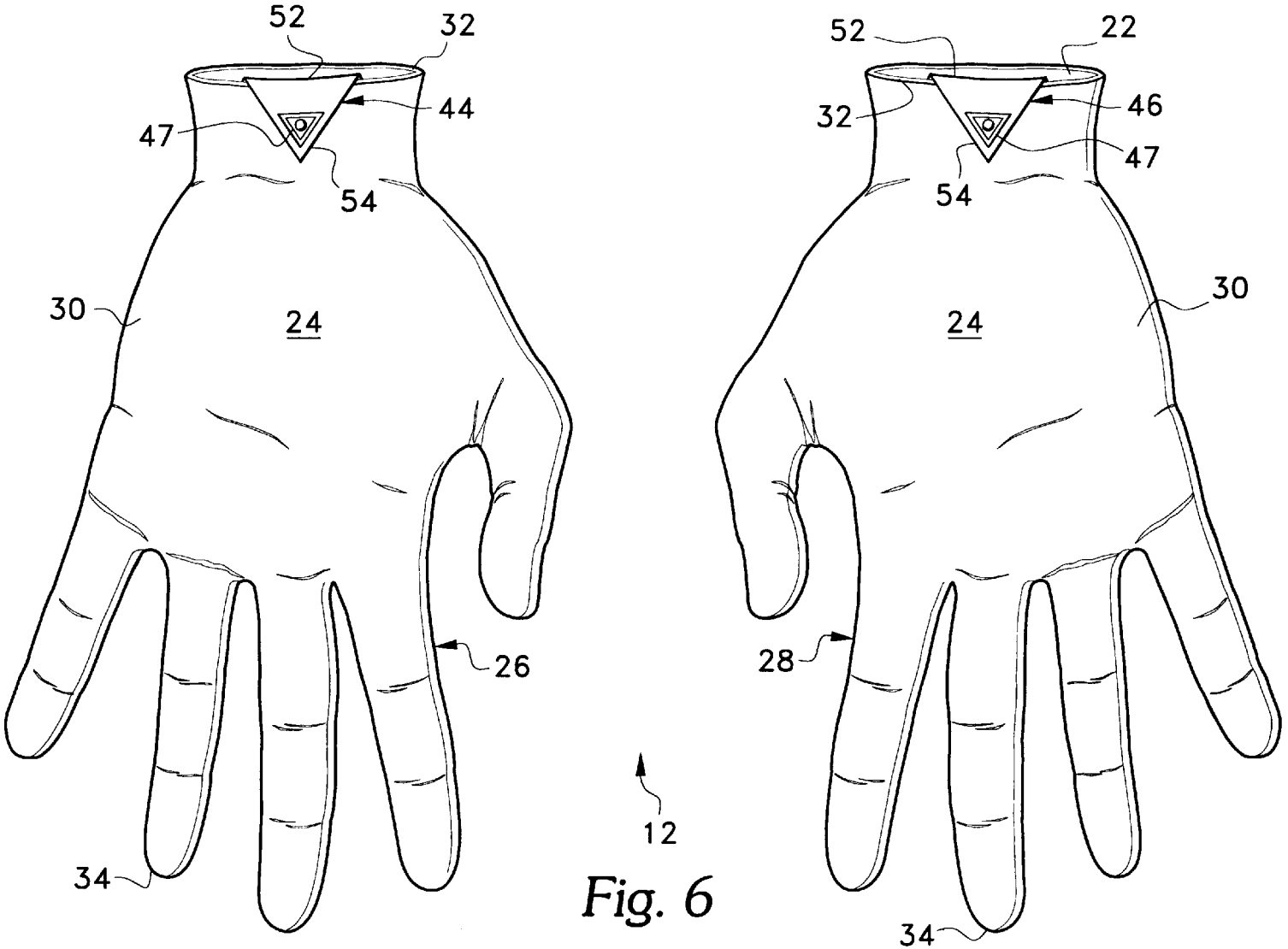
FIG. 6 is a perspective view of a glove pair having a tab with a triangular retaining snap fastener.

If the extension distance is greater than the fastener width, the sock or glove pair may include a tab snap fastener 58, as shown in FIG. 5. In this case, the upper portion 57 of each tab is located between one of the male and female parts and one of the securing parts of the tab snap fastener 58. Preferably each of the socks or gloves has one male part and one female part of the snap fasteners. The tab snap fastener makes the tab easy to grasp and provides a secure attachment for laundering. However, the additional length and the additional fastener make manufacture more complex and expensive, and can interfere with the wearer's comfort.

It is to be understood that the present invention is not limited to the embodiments described above, but encompasses any and all embodiments within the scope of the following claims.

I claim:

1. A sock pair, comprising:

(a) a first and a second sock, each sock having a leg portion and an upper edge, wherein the leg portion having a longitudinal axis;

(b) at least one snap fastener, the snap fastener having a male part, a female part, two securing parts, and a fastener width, wherein the male part and the female part being adapted to removably attach to each other, and at least one snap fastener being a retaining snap fastener;

(c) a first and a second tab, each tab being composed of a fabric strip, each tab being U-shaped and having an inner end, an outer end, a longitudinal axis, and a folded edge, wherein the folded edge of the first tab being located proximate to the upper edge of the first sock and the folded edge of the second tab being located proximate to the upper edge of the second sock, the inner and outer ends of each tab having an inner and an outer distal edge respectively, the longitudinal axis of each tab being generally parallel to the longitudinal axis of the leg portion of the corresponding sock, wherein the inner end of each tab being located between the corresponding sock and one of the securing parts of the retaining snap fastener, and the outer end of each tab being located between the corresponding sock and one of the male and female parts of the retaining snap fastener, wherein the male part and the corresponding securing part of the retaining snap fastener being fixedly attached to each other and retaining the first tab on the first sock, and the female part and the corresponding securing part of the retaining snap fastener being fixedly attached to each other and retaining the second tab on the second sock, wherein the retaining snap fastener being located at a fastener distance from the upper edge of each sock, and the fastener distance ranges from approximately the fastener width to approximately 2.5 times the fastener width; and (d) at least one indicia indicating the source of the sock, the indicia being located between the folded edge and the outer distal edge of at least one of the tabs.

2. The sock pair according to claim 1, wherein each of the parts of the retaining snap fastener has an outer edge proximate to one of the distal edges, and each outer edge has a shape, wherein each distal edge conforms to the shape of the corresponding outer edge, and each distal edge extends no further than the fastener width from the corresponding outer edge.

3. The sock pair according to claim 2, wherein each tab is generally rectangular and oblong, and each retaining snap fastener is generally square.

4. The sock pair according to claim 2, wherein each distal edge of each tab is semicircular, and each retaining snap fastener is generally round.

5. The sock pair according to claim 2, wherein each distal edge of each tab is angular, and each retaining snap fastener is generally triangular.

6. The sock pair according to claim 1, wherein the folded edge of each tab extends upward beyond the upper edge of each sock by an extension distance, and the extension distance is less than 2.5 times the fastener width.

7. The sock pair according to claim 1, wherein the fastener distance is approximately one and one-half times the fastener width.

8. The sock pair according to claim 1, wherein each tab has a single fold line at the folded edge.

9. The sock pair according to claim 1, wherein each tab is generally rectangular and oblong.

10. The sock pair according to claim 1, wherein each distal edge of each tab is semicircular.

11. The sock pair according to claim 1, wherein each distal edge of each tab is angular.

12. The sock pair according to claim 1, wherein the sock pair includes a single snap fastener.

13. The sock pair according to claim 1, wherein the sock pair includes two retaining snap fasteners, the fastener distance of each retaining snap fastener is approximately equal, and the retaining snap fasteners are separated from each other by a separation distance, wherein the separation distance ranges from approximately the fastener width to approximately 2.5 times the fastener width.

14. The sock pair according to claim 1, wherein the sock pair includes a tab snap fastener, and each tab has an upper portion, that extends from the folded edge of each tab to the upper edge of the sock to which the tab is attached, wherein the upper portion of each tab is located between one of the male and female parts and one of the securing parts of the tab snap fastener.

* * * * *